US008745999B2

(12) United States Patent
Hamada et al.

(10) Patent No.: US 8,745,999 B2
(45) Date of Patent: Jun. 10, 2014

(54) HEAT PUMP APPARATUS

(75) Inventors: Mamoru Hamada, Tokyo (JP); Fumitake Unezaki, Tokyo (JP); Yoshihiro Takahashi, Tokyo (JP); Kengo Takahashi, Tokyo (JP); Kazuki Okada, Tokyo (JP); Shinichi Uchino, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 659 days.

(21) Appl. No.: 13/057,362

(22) PCT Filed: Mar. 5, 2009

(86) PCT No.: PCT/JP2009/054147

§ 371 (c)(1),
(2), (4) Date: Feb. 3, 2011

(87) PCT Pub. No.: WO2010/023975

PCT Pub. Date: Mar. 4, 2010

(65) Prior Publication Data

US 2011/0132019 A1 Jun. 9, 2011

(30) Foreign Application Priority Data

Sep. 1, 2008 (JP) ..... 2008-223531

(51) Int. Cl.
*F25D 21/06* (2006.01)

(52) U.S. Cl.
USPC ..... 62/156; 62/234

(58) Field of Classification Search
USPC ..... 62/126, 129, 151, 156, 234, 155
See application file for complete search history.

(56) References Cited

U.S. PATENT DOCUMENTS

| | | | | |
|---|---|---|---|---|
| 4,918,942 | A * | 4/1990 | Jaster | 62/335 |
| 2003/0019221 | A1 * | 1/2003 | Rossi et al. | 62/127 |

FOREIGN PATENT DOCUMENTS

| | | | |
|---|---|---|---|
| JP | 60-133249 | A | 7/1985 |
| JP | 60-187851 | U | 12/1985 |
| JP | 61-110848 | A | 5/1986 |
| JP | 62-218749 | A | 9/1987 |
| JP | 1-147245 | A | 6/1989 |
| JP | 9-250794 | A | 9/1997 |
| JP | 10-111050 | A | 4/1998 |
| JP | 2002-130876 | A | 5/2002 |
| JP | 2005-188760 | A | 7/2005 |
| JP | 2007-225158 | A | 9/2007 |
| JP | 2008-145002 | A | 6/2008 |

OTHER PUBLICATIONS

International Search Report (PCT/ISA/210) issued on Jun. 2, 2009, by Japanese Patent Office as the International Searching Authority for International Application No. PCT/JP2009/54147.

(Continued)

*Primary Examiner* — Marc Norman
(74) *Attorney, Agent, or Firm* — Buchanan Ingersoll & Rooney PC

(57) ABSTRACT

A heat pump apparatus includes a refrigerant circuit in which a compressor, a condenser, expansion means, and an evaporator are serially connected. Condensation temperature detection means that detects a saturation temperature of the condenser, and evaporation temperature detection means that detects the saturation temperature of the evaporator are provided. Operation efficiency is estimated by a value obtained by dividing heating ability estimated from a detection value of the condensation temperature detection means by a difference between a detection value of condensation temperature detection means and that of evaporation temperature detection means or dissipation power estimated by the difference.

10 Claims, 13 Drawing Sheets

(56) References Cited

OTHER PUBLICATIONS

Office Action issued on Jun. 1, 2010, by Japanese Patent Office for Application No. 2008-223531.

Office Action dated Jun. 12, 2012, issued in corresponding Chinese Patent Application No. 200980133752.2, and an English Translation thereof. (7 pages).

* cited by examiner

HEAT PUMP APPARATUS

TECHNICAL FIELD

The present invention relates to a heat pump apparatus capable of defrosting operation, more particularly to a heat pump apparatus that precisely detects performance degradation due to frost formation onto an evaporator to execute defrosting start decision control processing that starts defrosting operation at an optimal timing.

BACKGROUND ART

In general, with an evaporator in a heat pump apparatus, a frost formation phenomenon occurs in which frost grows on the surface of the evaporator when an evaporation temperature is 0 degree or less, and at the same time, equal to or less than the dew-point temperature of the air. Such a frost formation phenomenon causes increase in ventilation resistance and thermal resistance to lower operating efficiency in the evaporator. Therefore, defrosting operation is necessary for the heat pump apparatus that introduces a discharged refrigerant from a compressor to the evaporator and removes the frost grown on the surface thereof.

Conventionally, the heat pump apparatus exists that can execute defrosting operation to dissolve frost attached onto the evaporator. For such an apparatus, "an air-conditioner" is proposed "that specifies an inrush timing of defrosting so that an average COP (Coefficient Of Performance) becomes a maximum value." (For example, refer to Patent Document 1) The air-conditioner calculates the average COP during heating operation using an indoor heat exchange temperature, an indoor temperature, and a current value to order the start of defrosting when the current average COP becomes smaller than the previous average COP.

CITATION LIST

Patent Document 1: Japanese Unexamined Patent Application Publication No. H10-111050 (page 3, FIG. 3)

SUMMARY OF INVENTION

Technical Problem

In the air-conditioner according to Patent Document 1, the average COP is estimated using the indoor heat exchange temperature, indoor air temperature, and compressor input. When the average COP begins to decrease, the defrosting operation is started. However, defrosting ability is the difference between the indoor heat exchange temperature and the indoor air temperature, as frost formation progresses, the indoor heat exchange temperature decreases and the indoor air temperature decreases as well. Therefore, there is a possibility of a false judgment that with a constant ability, only compressor input decreases and, on the contrary, the COP increases.

In the air-conditioner according to Patent Document 1, frosting operation is not considered when judging the start of defrosting, however, the COP at the time of the previous defrosting operation is adapted to be used. When not considering the defrosting operation, one cycle average COP including defrosting operation possibly deteriorates. When using the COP of the previous defrosting operation, since the COP at the previous defrosting operation is for the previous heating operation, the COP possibly deteriorates if it is applied to the current heating operation, in which operating statuses and load are changed.

The present invention is made to resolve the above problems and its object is Lo provide a heat pump apparatus capable of starting defrosting operation at the most efficient (COP is maximized) and optimal timing.

Solution to Problem

The heat pump apparatus according to the present invention includes a refrigerant circuit in which a compressor, a condenser, expansion means, and an evaporator are serially connected. There are provided condensation temperature detection means to detect the saturation temperature of the condenser, evaporation temperature detection means to detect the saturation temperature of the evaporator, and a control section to estimate operation efficiency by a value obtained by dividing heating ability estimated from the detection value of the condensation temperature detection means by a difference between the detection value of the condensation temperature detection means and that of the evaporation temperature detection means or dissipation power estimated from the difference.

The heat pump apparatus according to the present invention includes a refrigerant circuit in which a compressor, a condenser, expansion means, and an evaporator are serially connected. There are provided condensation temperature detection means to detect the saturation temperature) of the condenser, compressor operation current detection means to detect the operation current of the compressor, and a control section that estimates operation efficiency by a value obtained by dividing the heating ability estimated from the detection value of the condensation temperature detection means by the detection value of the compressor operation current detection means or dissipation power estimated by the detection value, and starts defrosting operation when the estimated operation efficiency is lowered from an averaged value from the start of operation to now to an estimation value of the operation efficiency from the start of operation to the end of defrosting operation when defrosting operation is performed now.

Advantageous Effects of Invention

With the heat pump apparatus according to the present invention, by accurately estimating heating COP from the condensation temperature and the evaporation temperature, and by estimating a one-cycle average COP including the defrosting operation, the defrosting operation can be started at an optimal timing when the one cycle average COP becomes the best, resulting in energy saving.

With the heat pump apparatus according to the present invention, by accurately estimating heating COP from the operation current of the compressor, and by estimating an one-cycle average COP including the defrosting operation, the defrosting operation can be started at an optimal timing when the one cycle average COP becomes the best, resulting in energy saving.

DESCRIPTION OF EMBODIMENTS

Embodiments of the present invention will be explained based on drawings.

Embodiment 1

Figure 1:
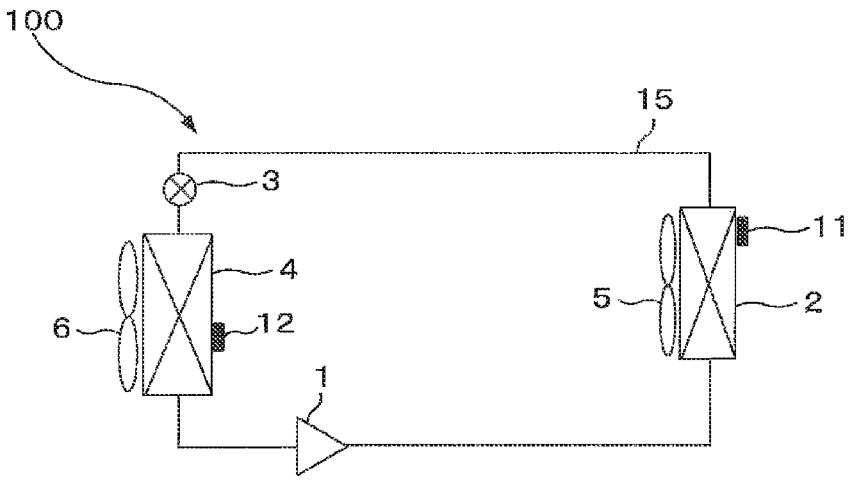
FIG. 1 is a schematic configuration diagram showing configuration of a refrigerant circuit of a heat pump apparatus according to Embodiment 1.

FIG. 1 is a schematic configuration diagram showing configuration of a refrigerant circuit of a heat pump apparatus 100 according to Embodiment 1. Based on FIG. 1, descriptions will be given to the configuration and operation of the refrigerant circuit of the heat pump apparatus 100. The heat pump apparatus 100 performs cooling operation or heating operation by circulating a refrigerant. Sizes of each component are sometimes different from actual ones in the following drawings including FIG. 1.

As shown in FIG. 1, the heat pump apparatus 100 is configured by serially connecting a compressor 1, a condenser 2, expansion means 3, and an evaporator 4 in order by refrigerant piping 15. In the vicinity of the condenser 2, a condenser fan 5 and condensation temperature detection means 11 are provided. In the vicinity of the evaporator 4, an evaporator fan 6 and evaporation temperature detection means 12 are provided. Detection values detected by the condensation temperature detection means 11 and the evaporation temperature detection means 12 are adapted to be transmitted to the control section 50 that integrally controls the entire heat pump apparatus 100.

The compressor 1 sucks the refrigerant flowing through refrigerant piping 15 to compress the refrigerant into a high-temperature high-pressure state. The condenser 2 performs heat exchange between the refrigerant passing through the refrigerant piping 15 and the air to condense the refrigerant. Expansion means 3 decompresses to expand the refrigerant passing through the refrigerant piping 15. The expansion means 3 may be configured by, for example, an electronic expansion valve and the like. The evaporator 4 performs heat exchange between the refrigerant passing through the refrigerant piping 15 and the air to evaporate the refrigerant. The condenser fan 5 supplies air to the condenser 2. The evaporator fan 6 supplies air to the evaporator 4. Condensation temperature detection means 11 detects the saturation temperature of the condenser 2. Evaporation temperature detection means 12 detects the saturation temperature of the evaporator 4.

A control section 50 is constituted by a microcomputer and the like and has a function to control the drive frequency of the compressor 1, the rotation speed of the condenser fan 5 and the evaporator fan 6, switching of a four-way valve (not shown), which is a flow path switching device of the refrigerant, and opening of the expansion means 3 based on detection values (condensation temperature information detected by condensation temperature detection means 11 and evaporation temperature information detected by evaporation temperature detection moans 12) from the above-mentioned each detection means. Regarding the control section 50, detailed descriptions will be given in FIG. 2.

Here, brief explanations will be given to the operation of the heat pump apparatus 100.

When the heat pump apparatus 100 starts operation, the compressor 1 is driven at first. Then, the high-temperature high-pressure gas refrigerant compressed by the compressor 1 is discharged from the compressor 1 to flow into the condenser 2. In the condenser 2, the inflow gas refrigerant condenses to turn into a low-temperature high-pressure refrigerant while radiating heat to the fluid. The refrigerant flows out of the condenser 2 and decompressed by the expansion means 3 to turn into a gas-liquid two-phase refrigerant. The gas-liquid two-phase refrigerant flows into the evaporator 4. The refrigerant flowed into the evaporator 4 is subjected to vaporizing and gasifying by absorbing heat from the fluid. The refrigerant flows out of the evaporator 4 to be reabsorbed by the compressor 1. Detection values from the condensation temperature detection means 11 and the evaporation temperature detection means 12 are transmitted to the control section 50 during operation of the heat pump apparatus 100.

Figure 2:
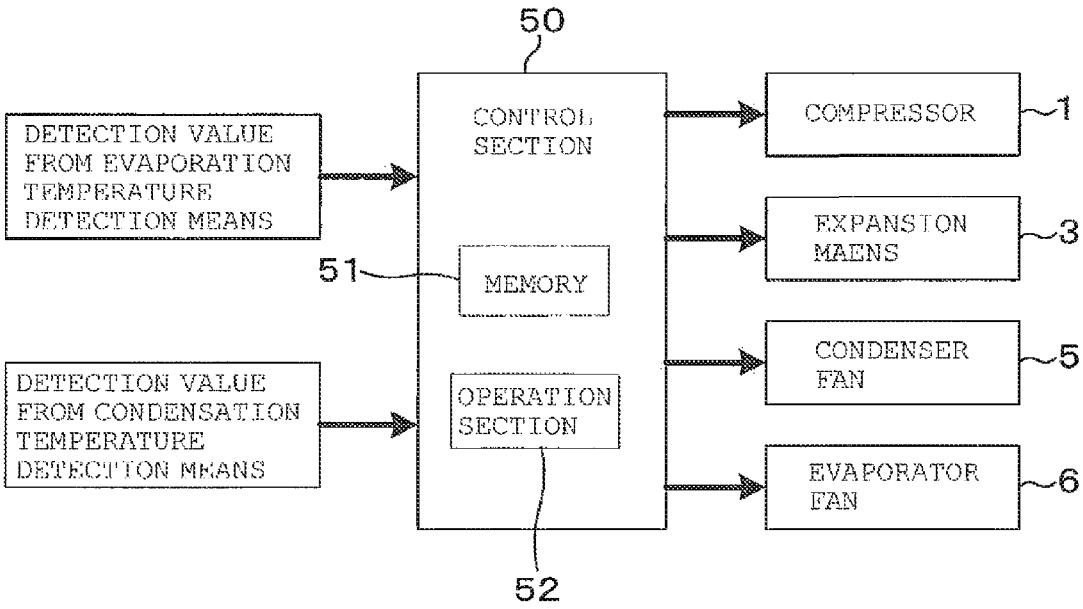
FIG. 2 is a block diagram showing an electrical schematic configuration of the heat pump apparatus.

FIG. 2 is a block diagram showing an electrical schematic configuration of the heat pump apparatus. Based on FIG. 2, detailed descriptions will be given to the function of the control. section 50. As shown in FIG. 2, the control section 50 includes a memory 51 and an operation section 52. Detection values detected by the condensation temperature detection means 11 and the evaporation temperature detection means 12 are transmitted and stored into a memory 51 of the control section 50. Detected values stored in the memory 51 are operated by the operation section 52. That is, the control section 50 is adapted to transmit a control signal to each drive section of the compressor 1, the four-way valve (not shown), the expansion means 3, the condenser fan 5, and the evaporator fan 6 based on calculation results information of the memory 51 and the operation section 52.

In this case, an instantaneous COP=COP that represents operation efficiency during heating operation is estimated from formula (1) as follows using the condensation temperature Tc and evaporation temperature Te. Formula (1) is a Carnot's efficiency definition formula. Power consumption is estimated by Tc−Te.

$$COP=(Tc+273.15)/(Tc-Te) \quad \text{Formula 1}$$

Figure 3:
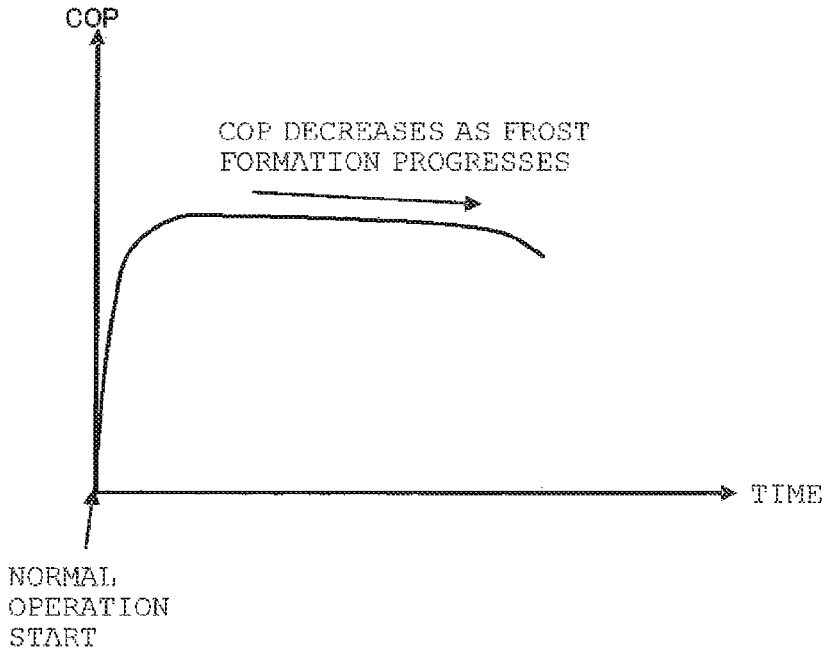
FIG. 3 is a graph showing a relation between time and COP.

FIG. 3 is a graph showing a relation between time and COP. Based on FIG. 3, descriptions will be given to a relation between time and COP of the heat pump apparatus 100. In FIG. 3, a horizontal axis represents time, and a vertical axis COP, respectively. In the heat exchange between the refrigerant and the air in the evaporator 4, a frost formation phenomenon occurs, in which water contained in the air attaches onto the evaporator 4 to grow into frost when the refrigerant temperature is 0 degree or lower and equal to or less than the dew-point temperature of the air. As the frost formation phenomenon progresses in the evaporator 4, heat exchange amount in the evaporator 4 decreases and the instantaneous COP is lowered as shown in FIG. 3 due to increase in the ventilation resistance and thermal resistance, therefore, defrosting operation is needed.

With the instantaneous COP=COP shown by formula (1), Te decreases more than Tc does as frost is formed and the lowering of the instantaneous COP can be accurately grasped. For example, with the condensation temperature Tc, Tc=49 degrees C. at the start of operation. Then, Tc=47 degrees C. at the time just before the start of defrosting, resulting in decrease of approximately two degrees. On the contrary, with the evaporation temperature Te, while Te=−2 degrees C. at the start of operation, Te=−6 degrees C. at the time just before the start of defrosting, resulting in decrease of approximately 4 degrees. As frost formation progresses, COP is lowered.

Figure 4:
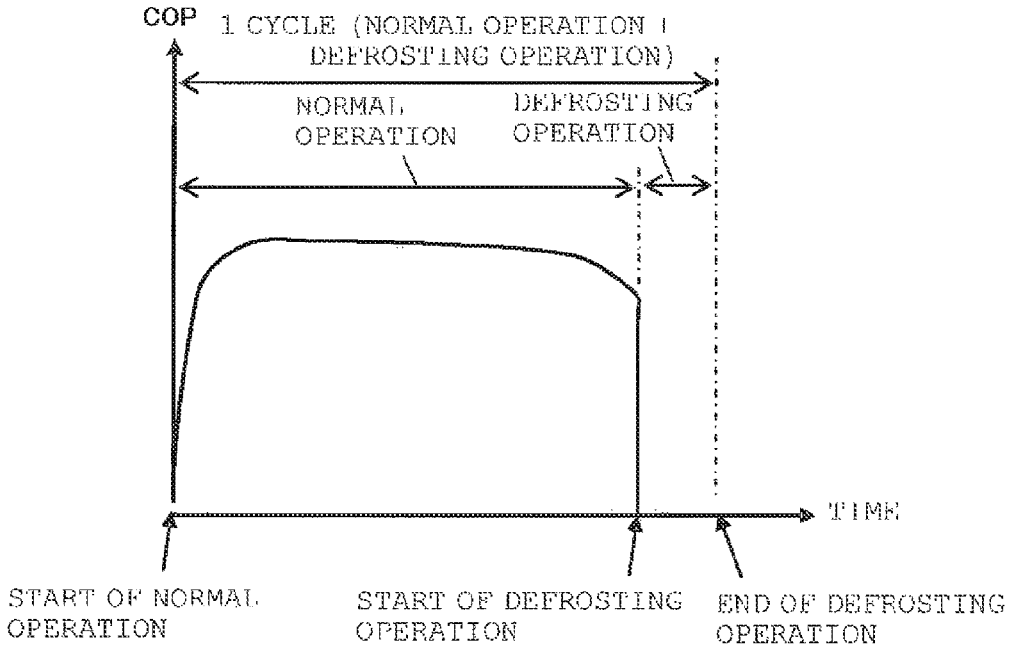
FIG. 4 is a graph showing a relation between time and COP.

FIG. 4 is a graph showing a relation between time and COP. Based on FIG. 4, descriptions will be given to a one-cycle average COP of the heat pump apparatus. In the case of the operation accompanying defrosting operation, operation efficiency is evaluated by a one-cycle average COP with from the start of operation to the end of defrosting operation being one-cycle. That is, to start the defrosting operation becomes important at a timing of the maximum of one-cycle average COP. If the defrosting operation is started at this timing, energy saving can be effectively achieved.

Figure 5:
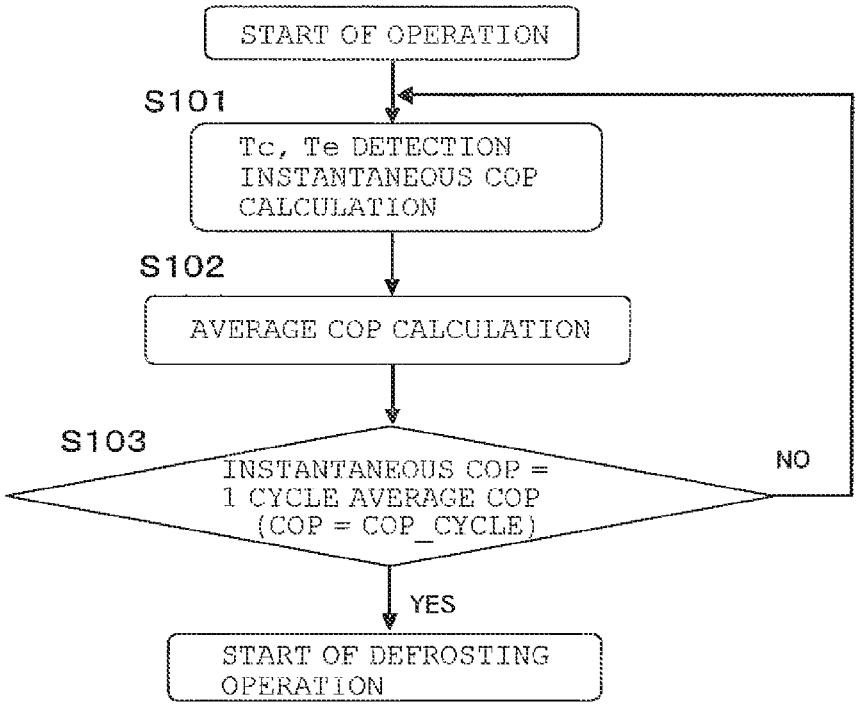
FIG. 5 is a flowchart showing an example of a processing flow regarding defrosting start decision control of the heat pump apparatus.
Figure 6:
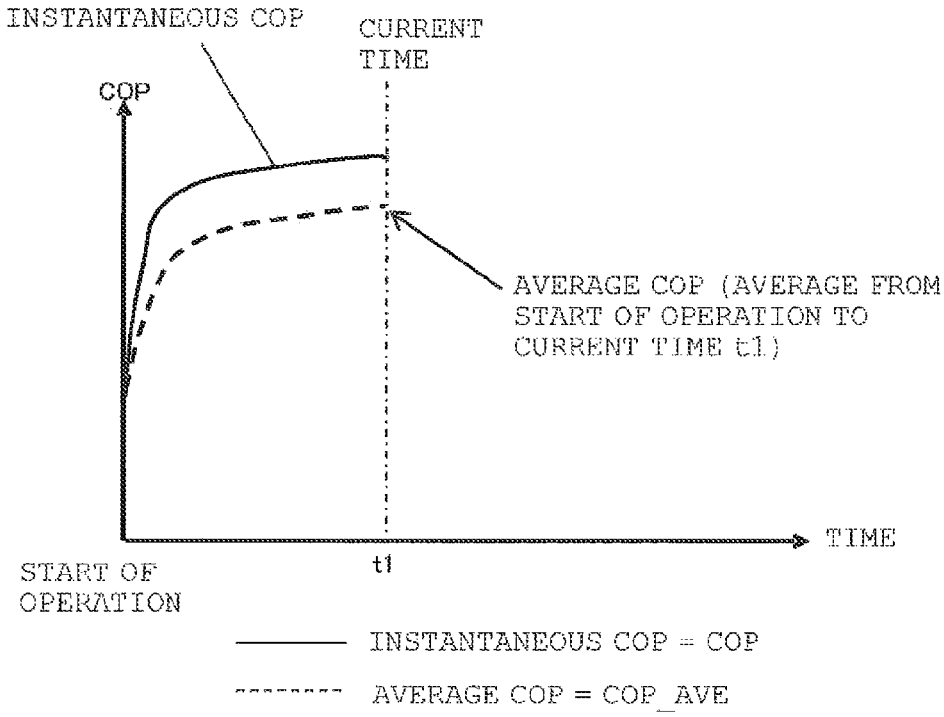
FIG. 6 is a graph showing a relation between an instantaneous COP and an average COP.
Figure 7:
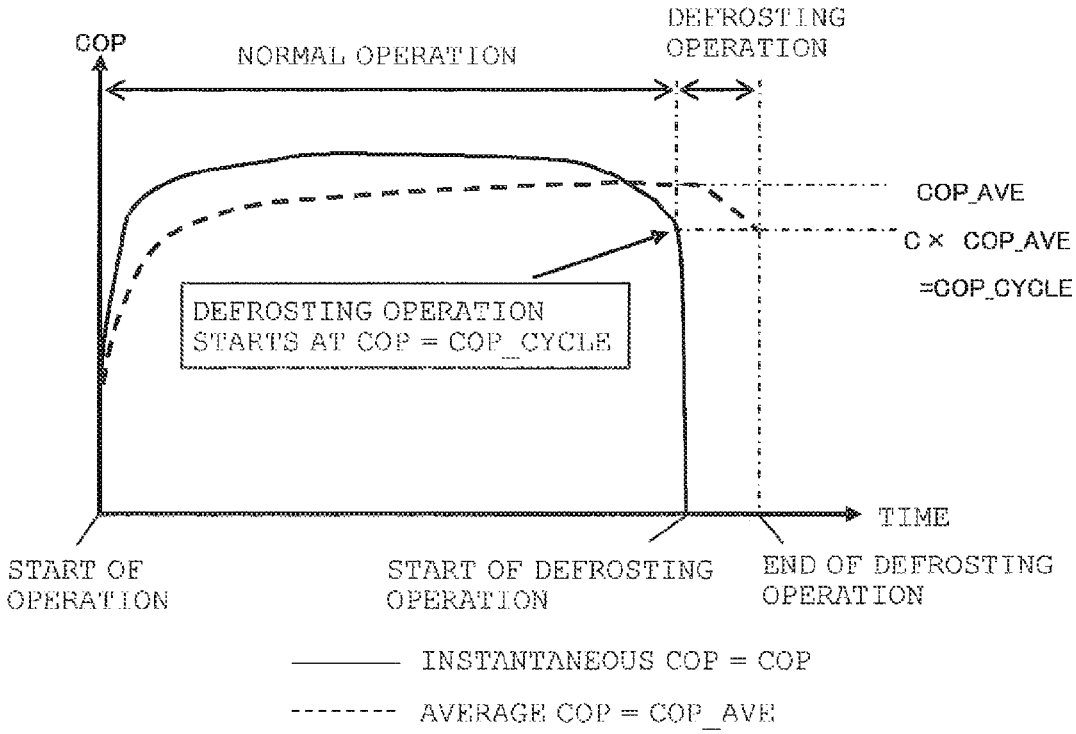
FIG. 7 is a graph showing a relation between the instantaneous COP and a one-cycle average COP.
Figure 8:
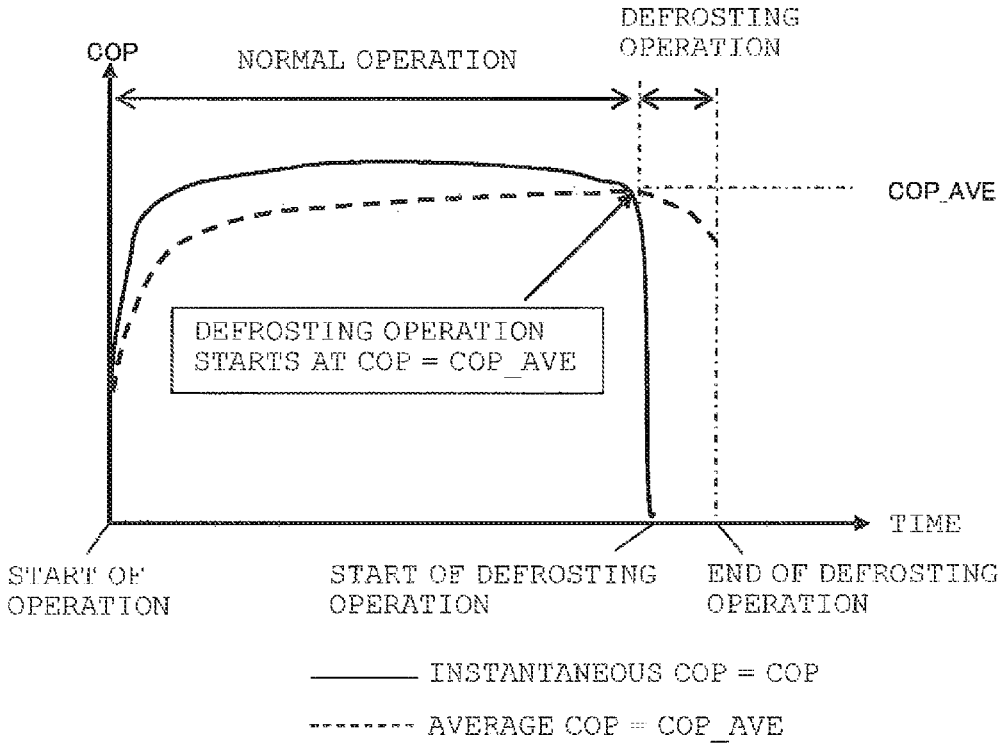
FIG. 8 is a graph showing a relation between the instantaneous COP and the average COP.
Figure 9:
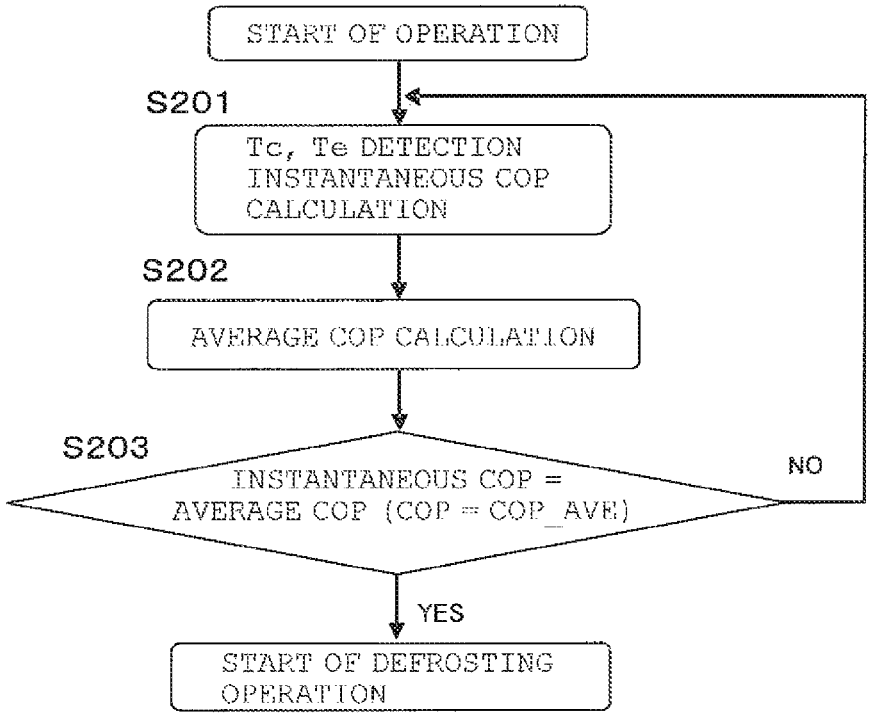
FIG. 9 is a flowchart showing another example of a processing flow regarding a defrosting start decision control of the heat pump apparatus.

FIG. 5 is a flowchart showing an example of a processing flow regarding defrosting start decision control of the heat pump apparatus 100. FIG. 6 is a graph showing a relation between an instantaneous COP and an average COP. FIG. 7 is a graph showing a relation between the instantaneous COP and a one-cycle average COP. FIG. 8 is a graph showing a relation between the instantaneous COP and the average COP. FIG. 9 is a flowchart showing another example of a processing flow regarding defrosting start decision control of the heat pump apparatus 100. Based on FIGS. 5 to 9, descriptions will be given to a processing flow on the defrosting start decision control of the heat pump apparatus 100. In FIGS. 6 to 8, the horizontal axis represents time, and the vertical axis COP, respectively.

When the heat pump apparatus 100 starts operation, the control section 50 performs operation of the instantaneous COP=COP shown by the above formula (1) from the condensation temperature Tc, which is a detection value detected by the condensation temperature detection means 11, and the defrosting temperature Te, which is a detection value detected by the evaporation temperature detection means 12. (step S101) Thereafter, the control section calculates an average COP=COP_AVE from the start of the normal operation to now as shown in FIG. 6. (step S102) As shown in FIG. 7, the defrosting start timing having the highest one-cycle COP=COP_CYCLE is when the instantaneous COP=COP is lowered to the one-cycle average COP=COP_CYCLE due to frost formation.

The one-cycle average COP=COP_CYCLE when starting the defrosting operation now is represented by formula (2) as follows using the average COP=COP_AVE from the start of the normal operation to now.

$$COP_CYCLE=C\times COP_AVE \quad \text{Formula (2)}$$

C in the right-hand side of the above formula (2) takes decrease in the average COP caused by the defrosting operation into consideration as shown in FIG. 7. The C may be a preset constant. For example, when the one-cycle average COP becomes 96% of the average COP=COP_AVE at the time of heating operation due to defrosting, C=0.96. The C may be optimally set as needed because optimal values depend on method of defrosting and the specification of the apparatus.

To calculate the one-cycle average COP from the above formula (2) when starting the defrosting operation now and compare it with the instantaneous COP=COP now. (step S103) As a result, to start defrosting operation when the relation shown in formula (3) as follows holds. (step S103; YES) On the other hand, formula (3) as follows does not hold (step S103; NO), return to step S101 to repeat the above process.

$$COP=COP_CYCLE \quad \text{Formula (3)}$$

In step S103, the defrosting operation may be started when the current instantaneous COP decreases to the average COP=COP_AVE up to now instead of the one-cycle average COP. The flowchart then is shown in FIG. 9. In step S203, the defrosting operation starts when formula (4) as follows comes into effect. Other steps are the same as FIG. 5.

$$COP=COP_AVE \quad \text{Formula (4)}$$

Figure 10:
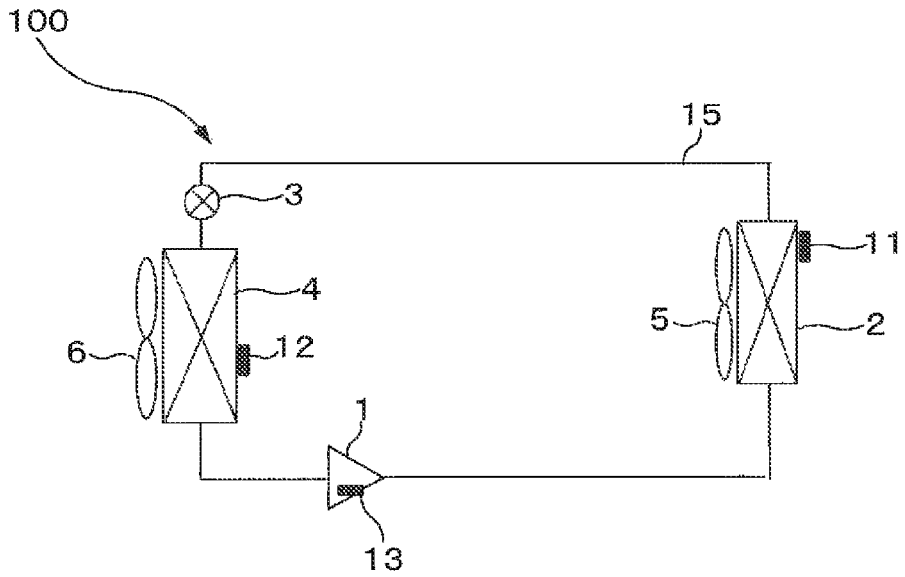
FIG. 10 is a schematic configuration diagram showing a refrigerant circuit configuration under a state in which the heat pump apparatus includes compressor operation time measurement means.
Figure 11:
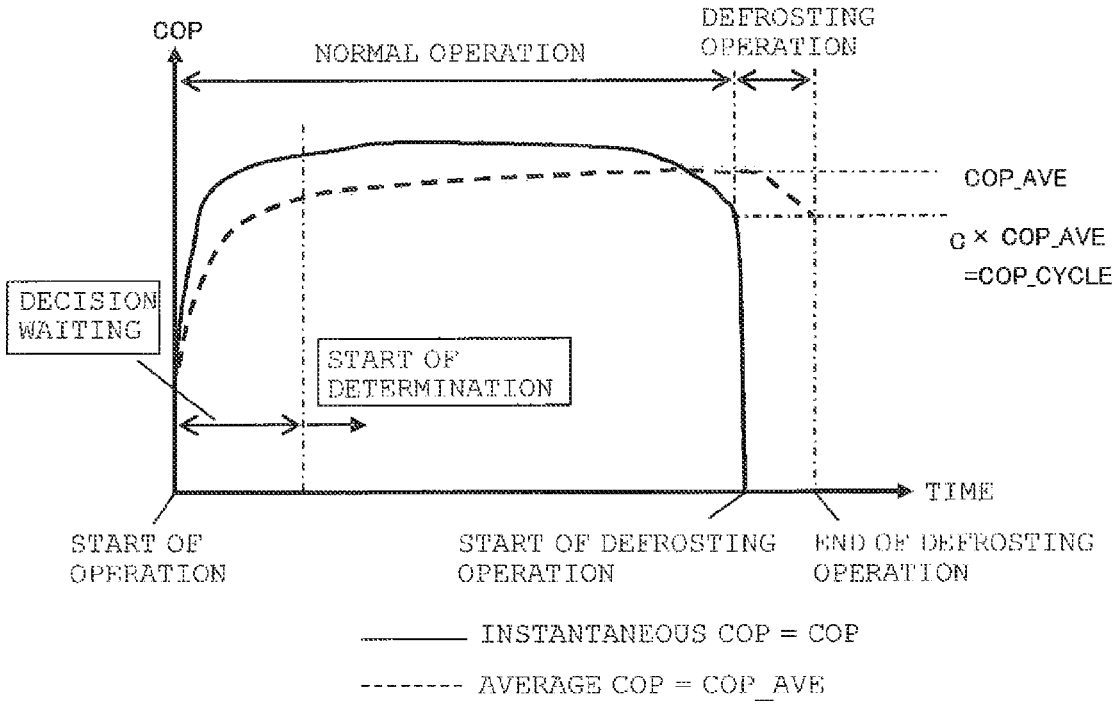
FIG. 11 is a graph showing a relation between the instantaneous COP and the one-cycle average COP of the heat pump apparatus.

FIG. 10 is a schematic configuration diagram showing a refrigerant circuit configuration under a state in which the heat pump apparatus 100 includes compressor operation time measurement means 13. FIG. 11 is a graph showing a relation between the instantaneous COP and the one-cycle average COP of the heat pump apparatus 100. Descriptions will be given to a case in which defrosting start decision is performed after the operation of the compressor 1 lasted for a certain time based on FIGS. 10 and 11. As shown in FIG. 10, the compressor 1 is provided with compressor operation Lime measurement means 13. The measurement time in the compressor operation time measurement means 13 is adapted to be sent to the control section 50.

Since the refrigeration cycle is not stable right after the start of the compressor 1, the certain time may be set as the time from when the compressor 1 starts operation until the refrigeration cycle stabilizes sufficiently, for example 20 minutes, or may be set to be further shorter unless no problem exists for the defrosting start decision. Therefore, from FIGS. 10 and 11, the heat pump apparatus 100 may start the defrosting start decision after the elapse of a certain time from the start of the compressor 1. Preferably, the certain time may be changed.

The decision start time can be changed depending on the frost formation amount by setting the certain time to 30 minutes when the previous defrosting time is equal to 5 minutes or less and to 20 minutes when the previous defrosting time is equal to 5 minutes or larger.

Figure 12:
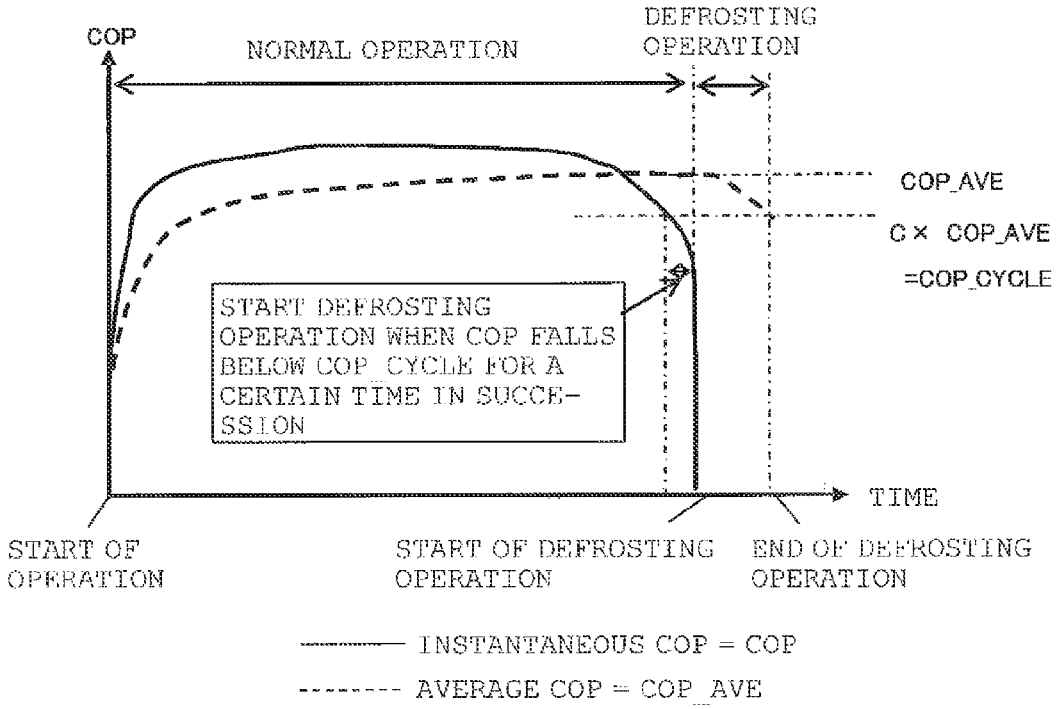
FIG. 12 is a graph showing a relation between the instantaneous COP and the one-cycle average COP of the heat pump apparatus.
Figure 13:
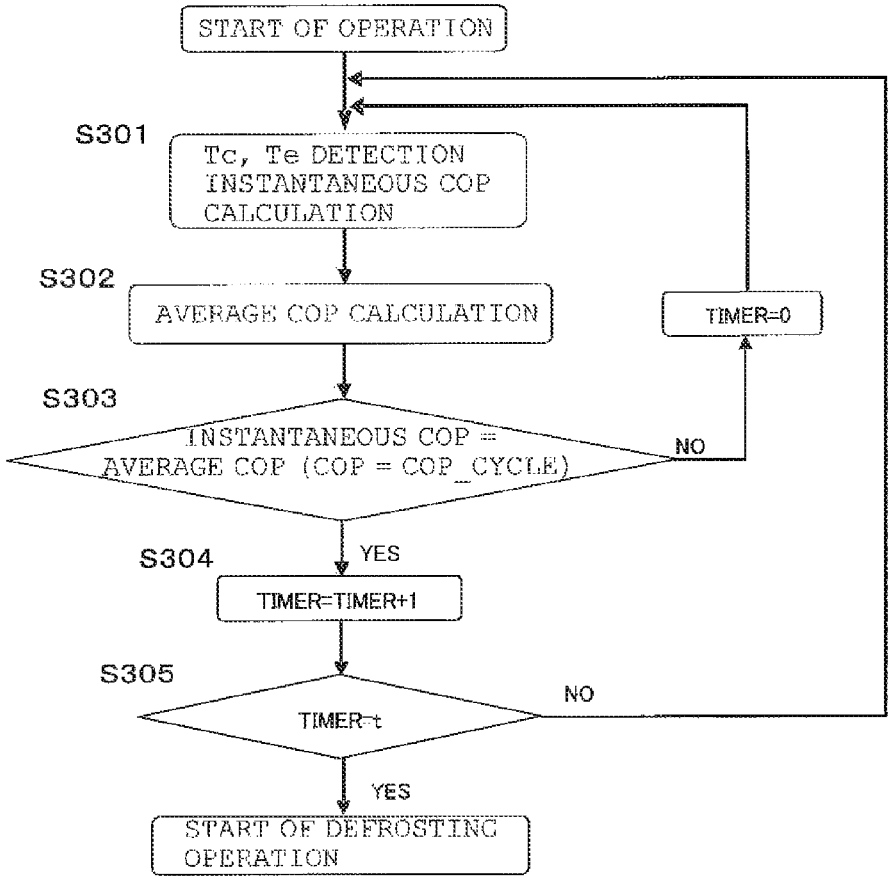
FIG. 13 is a flowchart showing another example of the processing flow regarding defrosting start decision control of the heat pump apparatus.

FIG. 12 is a graph showing a relation between the instantaneous COP and the one-cycle average COP of the heat pump apparatus 100. FIG. 13 is a flowchart showing another example of the processing flow regarding the defrosting start decision control of the heat pump apparatus 100. Descriptions will be given to the processing flow of the case in which defrosting operation starts when the instantaneous COP=COP falls below the one-cycle average COP=COP_CYCLE for a certain time in succession based on FIGS. 12 and 13. In FIG. 12, the horizontal axis represents time, and the vertical axis COP, respectively. Parts in FIG. 13 with no explanations in particular have the same contents as those explained in FIG. 5.

The heat pump apparatus 100 may start defrosting operation when the instantaneous COP=COP falls below the one-cycle average COP=COP_CYCLE for a certain time in succession as shown in FIG. 12. The flowchart then is shown in FIG. 13. The defrosting operation is started when a timer TIMER is counted in step S304 and it is judged in step S305 that a certain time t has elapsed after the timer TIMER was set. (step S305; YES) If the conditions of step S303 are not fulfilled (step S305; NO) before the certain time t elapsed, reset the timer TIMER to redo the judgment. Thereby, the start of a false defrosting operation can be avoided when the instantaneous COP=COP falls below the one-cycle average COP=COP_CYCLE due to a sudden change in noises and the like.

Figure 14:
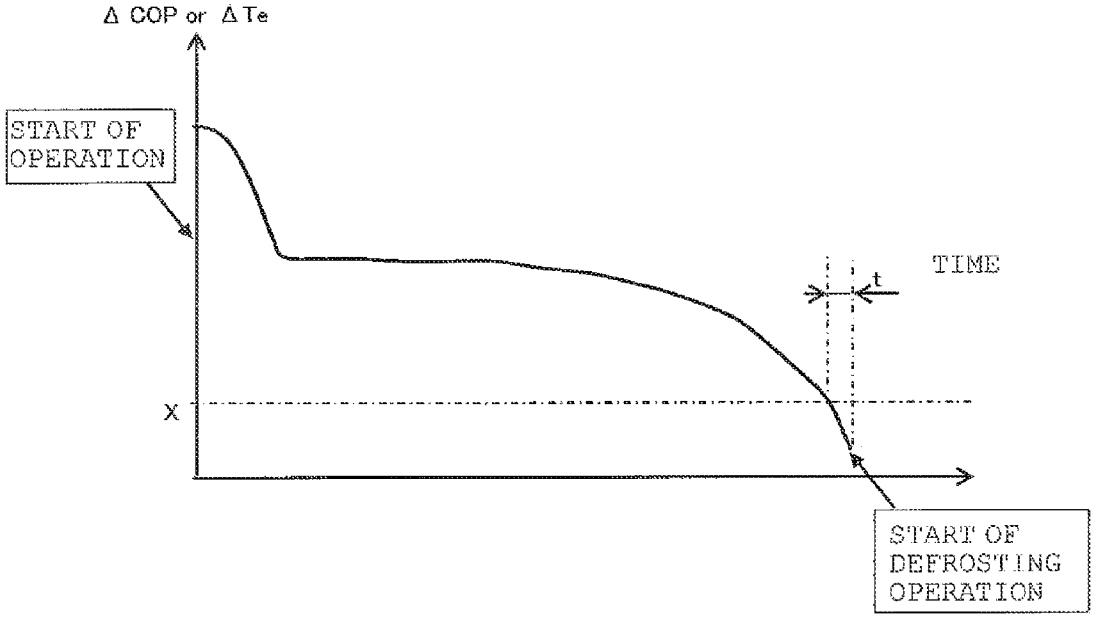
FIG. 14 is a graph showing a relation between time variation of COP and time of the heat pump apparatus.
Figure 15:
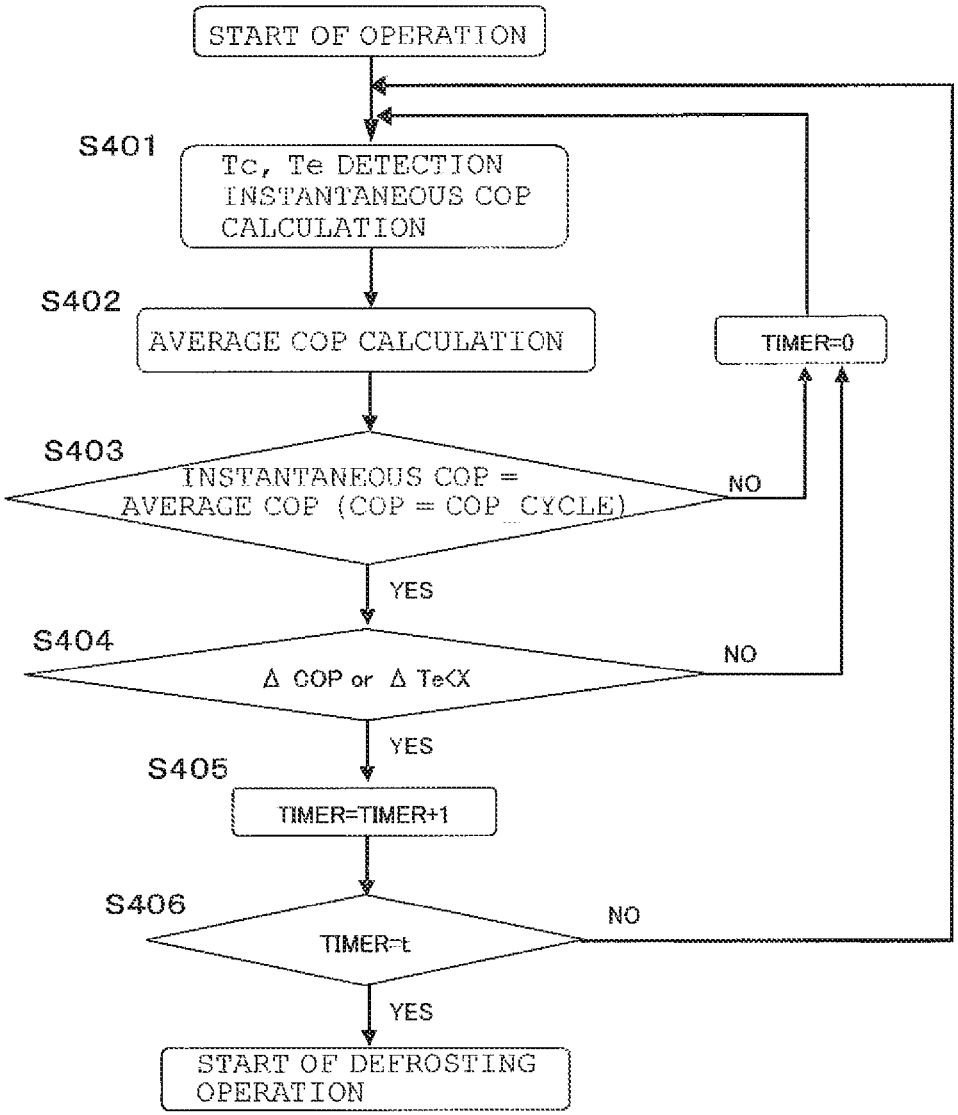
FIG. 15 is a flowchart showing another example of the processing flow regarding defrosting start decision control of the heat pump apparatus.

FIG. 14 is a graph showing a relation between time variation of COP and time of the heat pump apparatus 100. FIG. 15 is a flowchart showing another example of the processing flow regarding a defrosting start decision control of the heat pump apparatus 100. Based on FIGS. 14 and 15, descriptions will be given to the processing flow when defrosting operation starts in the case where the instantaneous COP=COP falls below the one-cycle average COP=COP_CYCLE, and variations ΔCOP of the instantaneous COP=COP within a certain time or variations Δ Te of the evaporation temperature within a certain time fall below a preset value X for a certain time in succession. In FIG. 14, the horizontal axis represents time, and the vertical axis Δ COP or ΔTe, respectively. Parts in FIG. 15 with no explanations in particular have the same contents as those explained in FIG. 5.

The heat pump apparatus 100 may start defrosting operation when the instantaneous COP=COP falls below the one-cycle average COP=COP_CYCLE and, as shown in FIG. 14, variations ΔCOP of the instantaneous COP=COP within a certain time or variations ΔTe of the evaporation temperature Te within a certain time fall below a preset value X for a certain time t in succession. The flowchart then is shown in FIG. 15. If ΔCOP or ΔTe falls below X at step S404 (step S404; YES), count of the timer TIMER is started at step S405. If it is judged that the timer TIMER undergoes a certain time t at step S406, defrosting operation is started. (step S406; YES)

Conditions of step S403 or step S404 are not fulfilled before elapsing a certain time t (step S403; NO, or step S404; NO), reset the timer TIMER to redo the judgment. Thereby, a false defrosting operation start can be avoided caused by a sudden change in noises, a change of compressor frequency, and a temporarily change in COP due to load variations. The condensation temperature detection means 11 in Embodiment 1 may be means to directly measure temperature by a thermistor, means to convert a condensation temperature from a pressure sensor, or means to estimate the condensation temperature. The evaporation temperature detection means 12 in Embodiment 1 may be means to directly measure temperature by the thermistor, means to convert the condensation temperature from the pressure sensor, or means to estimate the condensation temperature.

Embodiment 2

Figure 16:
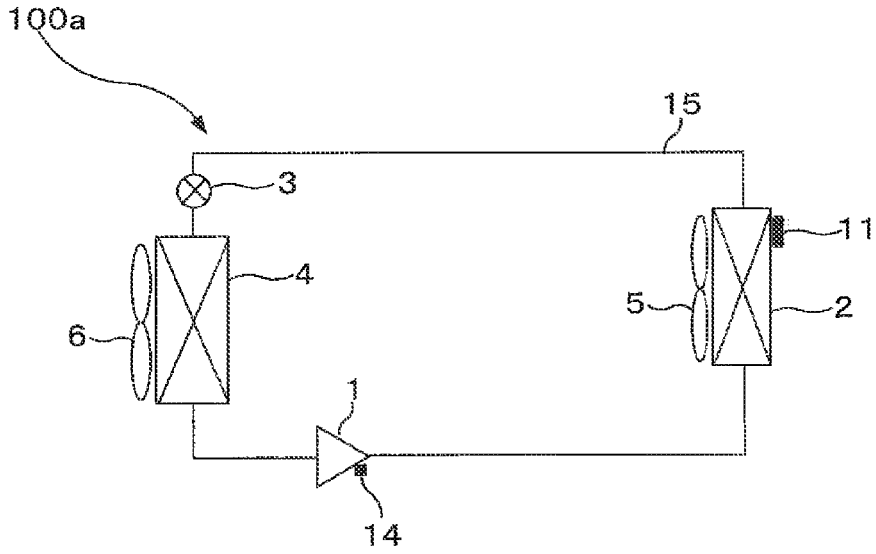
FIG. 16 is a schematic configuration diagram showing configuration of a refrigerant circuit of a heat pump apparatus according to Embodiment 2.

FIG. 16 is a schematic configuration diagram showing configuration of a refrigerant circuit of a heat pump apparatus 100*a* according to Embodiment 2 of the present invention. Based on FIG. 16, descriptions will be given to configuration and operation of the refrigerant circuit of the heat pump apparatus 100*a*. The heat pump apparatus 100*a* performs cooling operation or heating operation by circulating the refrigerant. In Embodiment 2, the same signs will be given to the same portions as Embodiment 1, and descriptions will be given to differences from Embodiment 1.

As shown in FIG. 16, the heat pump apparatus 100*a* is configured by serially connecting a compressor 1, a condenser 2, expansion means 3, and an evaporator 4 in order by refrigerant piping 15. In the vicinity of the condenser 2, a condenser fan 5 and condensation temperature detection means 11 are provided. In the vicinity of the evaporator 4, the evaporator fan 6 is provided. With the compressor 1, compressor operation current detection means 14 to detect the operation current of the compressor 1 is provided. Detection values detected by condensation temperature detection means 11 and compressor operation current detection means 14 are adapted to be sent to the control section 50 that integrally controls the entire heat pump apparatus 100. That is, the heat pump apparatus 100*a* is different from the heat pump apparatus 100 in that no evaporation temperature detection means 12 is provided but compressor operation current detection means 14 is provided.

Here, operation of the heat pump apparatus 100*a* will be briefly explained.

When the heat pump apparatus 100*a* starts operation, the compressor 1 is driven. The high-temperature high-pressure gas refrigerant compressed in the compressor 1 is discharged therefrom to flow into the condenser 2. In the condenser 2, the incoming gas refrigerant is decompressed while radiating heat to the fluid to turn into a low-temperature high-pressure refrigerant. The refrigerant flows out of the condenser 2 and decompressed by expansion means 3 to turn into a gas-liquid two-phase refrigerant. The gas-liquid two-phase refrigerant flows into the evaporator 4. The refrigerant flowed into the evaporator 4 is vaporized and gasified by absorbing heat from the fluid. The refrigerant flows out of the evaporator 4 to be re-absorbed by the compressor 1. During the operation of the heat pump apparatus 100, detection values from condensation temperature detection means 11 and compressor operation current detection means 14 are sent to the control section 50.

Figure 17:
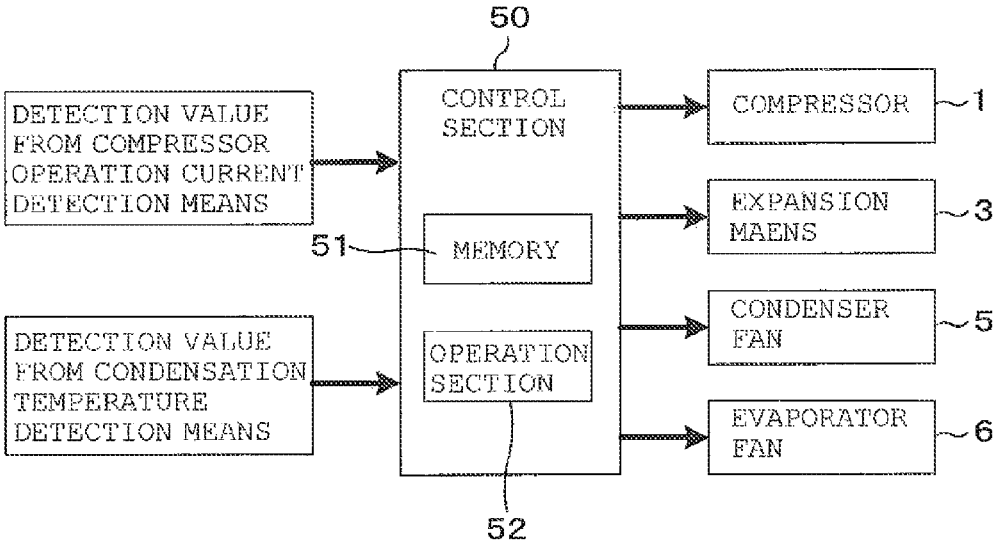
FIG. 17 is a block diagram showing an electrical schematic configuration of the heat pump apparatus.

FIG. 17 is a block diagram showing an electrical schematic configuration of the heat pump apparatus 100*a*. Based on FIG. 17, detailed descriptions will be given to the function of the control section 50. As shown in FIG. 17, the control section 50 includes a memory 51 and an operation section 52. Detection values by condensation temperature detection means 11 or compressor operation current detection means 14 are sent to the memory 51. of the control section 50 to be stored. The detection values stored in the memory 51 are operated by the operation section 52. That is, the control section 50 is adapted to send control signals to each drive section of the compressor 1, a four-way valve (not shown), expansion means 3, the condenser fan 5, and the evaporator fan 6 based on calculation results information in the memory 51 and the operation section 52.

In this case, COP representing operation efficiency during heating operation is estimated by formula (5) as follows using the condensation temperature Tc and the compressor operation current Ac. Dissipation power is estimated by Ac $$COP=(Tc+273.15)/Ac \qquad \text{Formula (5)}$$

As mentioned above, with the heat exchange between the refrigerant and the air in the evaporator 4, when the temperature of the refrigerant is 0 degree or less and equal to or less than the dew-point temperature of the air, a frost formation phenomenon occurs in which the water contained in the air attaches to the evaporator 4 to grow into frost. As the frost formation phenomenon progresses in the evaporator 4, the heat exchange amount in the evaporator 4 decreases due to increase in the ventilation resistance and thermal resistance to lower COP as shown in FIG. 3, resulting in the need of defrosting operation. In the case of the operation accompanying the defrosting operation, COP is evaluated by one-cycle average COP, in which one cycle is from the start of the normal operation to the end of the defrosting operation as shown in FIG. 4. That is, it is important to start defrosting operation at the timing when the one-cycle average COP becomes the highest. Energy saving can be effectively achieved if the defrosting operation is started at this timing.

Figure 18:
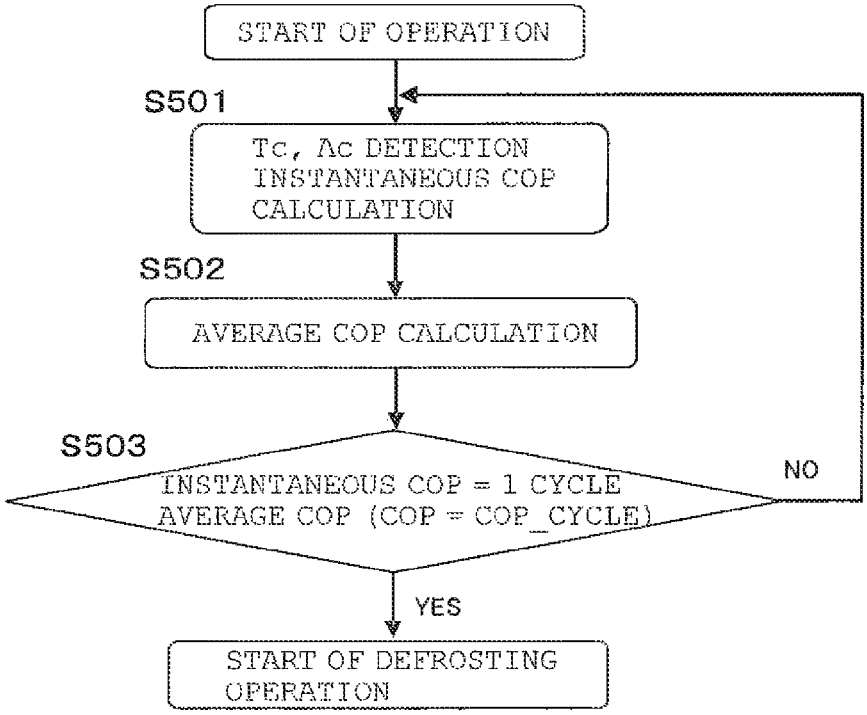
FIG. 18 is a flowchart showing an example of the processing flow regarding defrosting start decision control of the heat pump apparatus.

FIG. 18 is a flowchart showing an example of the processing flow regarding defrosting start decision control of the heat pump apparatus 100*a*. Based on FIG. 18, descriptions will be given to the processing flow in relation to defrosting start decision control of the heat pump apparatus 100*a*. When the heat pump apparatus 100*a* starts operation, the control section 50 performs operation of instantaneous COP=COP represented by the above formula (5) from the condensation temperature Tc, which is the detection value detected by the condensation temperature detection means 11, and the compressor operation current Ac, which is the detection value detected by the compressor operation current detection means 14. (step S501)

Thereafter, the control section 50 calculates average COP=COP_AVE from the start of the normal operation up to now as shown in FIG. 6. (step S502) As shown in FIG. 7, the defrosting start timing at which one-cycle COP=COP_CYCLE becomes the highest is when the instantaneous COP=COP is decreased to one-cycle average COP=COP_CYCLE due to frost formation. The one-cycle average COP=COP_CYCLE at the start of the defrosting operation at present is represented by formula (6) as follows using the average COP=COP_AVE from the start of the normal operation up to now.

$$COP_CYCLE=C\times COP_AVE \qquad \text{Formula (6)}$$

C in the right-hand side of the above formula (6) takes decrease in the average COP caused by the defrosting operation into consideration as shown in FIG. 7. The C may be a preset constant. For example, when the one-cycle average COP becomes 96% of the average COP=COP_AVE at the time of heating operation due to defrosting, C=0.96. C may be optimally set as needed because optimal values depend on method of defrosting and the specification of the apparatus.

To calculate the one-cycle average COP from the above formula (6) when starting the defrosting operation now and compare it with the instantaneous COP=COP now. (step S503) As a result, to start defrosting operation when the relation shown in formula (7) as follows holds. (step S503; YES) On the other hand, formula (7) as follows does not hold (step S503; NO), return to step S501 to repeat the above process.

$$COP=COP_CYCLE \qquad \text{Formula (7)}$$

Figure 19:
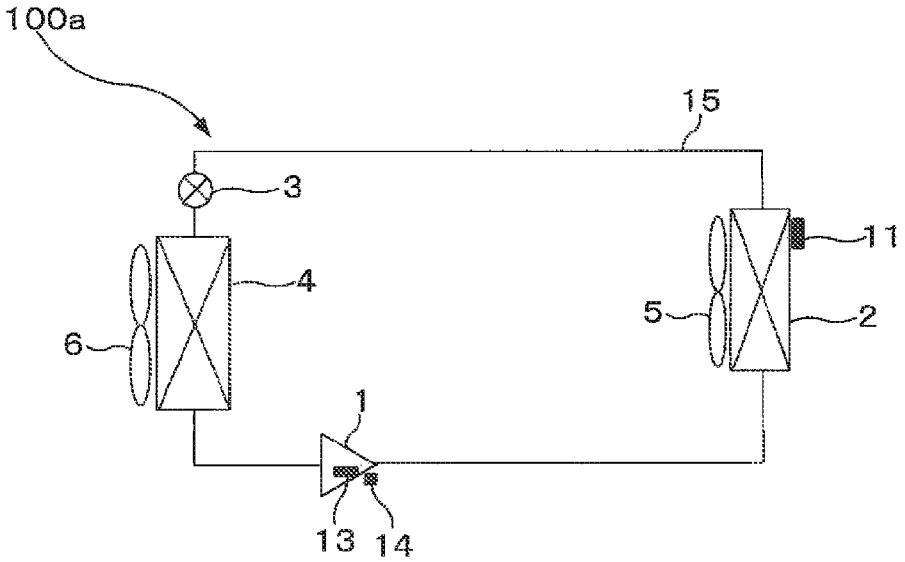
FIG. 19 is a schematic configuration diagram showing configuration of a refrigerant circuit under a state in which the heat pump apparatus includes compressor operation time measurement means.
Figure 20:
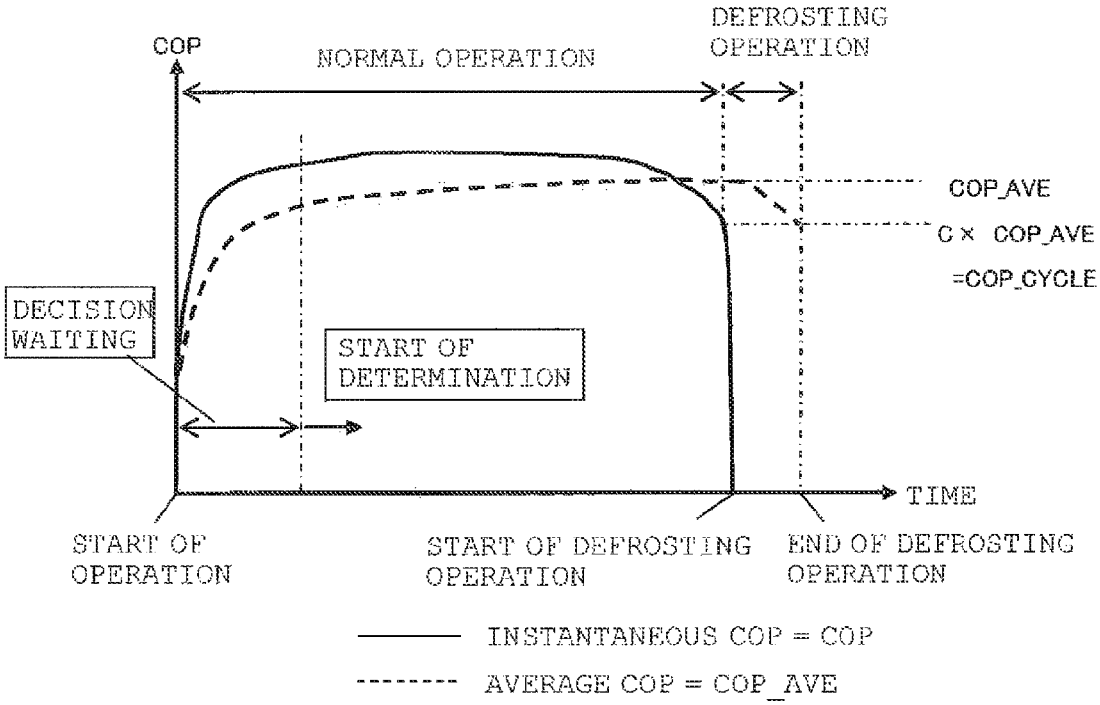
FIG. 20 is a graph showing a relation between the instantaneous COP and the one-cycle average COP of the heat pump apparatus.

FIG. 19 is a schematic configuration diagram showing a refrigerant circuit configuration under a state in which the heat pump apparatus 100*a* includes compressor operation time measurement means 13. FIG. 20 is a graph showing a relation between the instantaneous COP and the one-cycle average COP of the heat pump apparatus 100*a*. Descriptions will be given to a case in which defrosting start decision is performed after the operation of the compressor 1 lasted for a certain time based on FIGS. 19 and 20. As shown in FIG. 19, the compressor 1 is provided with compressor operation time measurement means 13. The measurement time in the compressor operation time measurement means 13 is adapted to be sent to the control section 50.

Since the refrigeration cycle is not stable right after the start of the compressor 1, the certain time may be set as the time from when the compressor 1 starts operation until the refrigeration cycle stabilizes sufficiently, for example 20 minutes, or may be set to be further shorter unless no problem exists for the defrosting start decision. Therefore, from FIGS. 10 and 11, the heat pump apparatus 100 may start the defrosting start decision after the elapse of a certain time from the start of the compressor 1. Preferably, the certain time may be changed.

Figure 21:
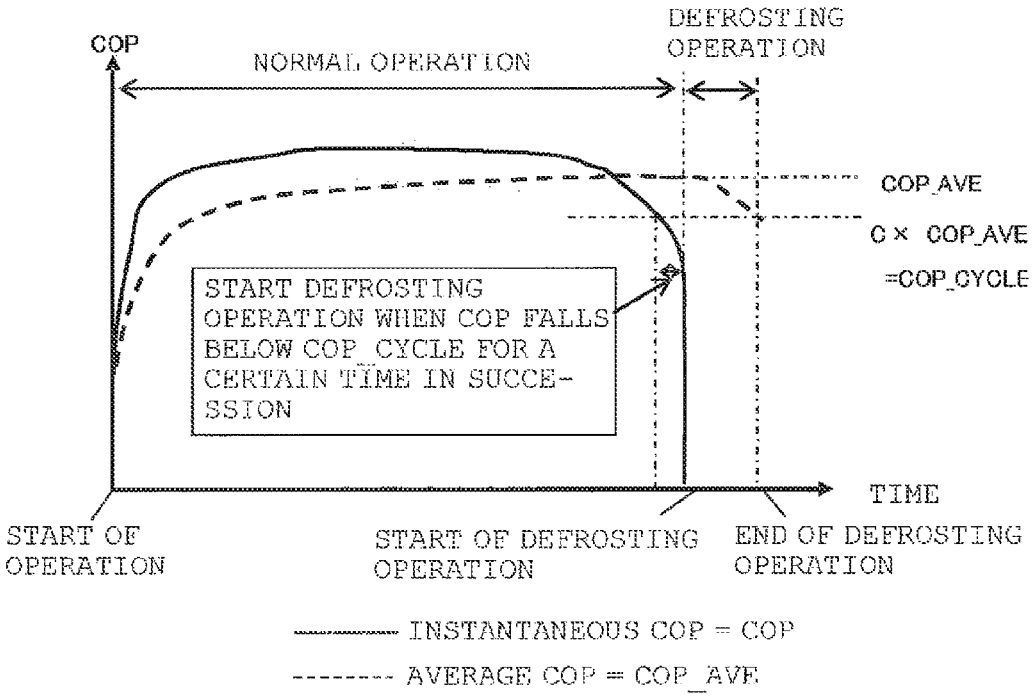
FIG. 21 is a graph showing a relation between the instantaneous COP and the one-cycle average COP of the heat pump apparatus.
Figure 22:
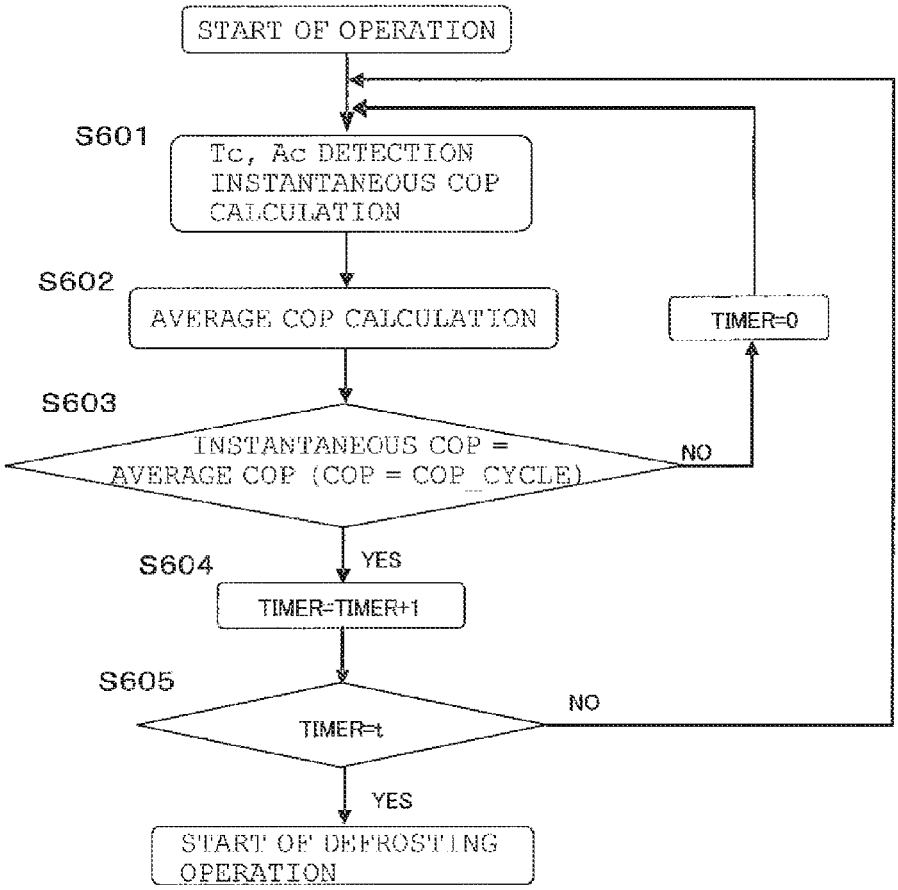
FIG. 22 is a flowchart showing another example of the processing flow regarding defrosting start decision control of the heat pump apparatus.

FIG. 21 is a graph showing a relation between the instantaneous COP and the one-cycle average COP of the heat pump apparatus 100*a*. FIG. 22 is a flowchart showing another example of the processing flow regarding the defrosting start decision control of the heat pump apparatus 100*a*. Descriptions will be given to the processing flow of the case in which defrosting operation starts when the instantaneous COP=COP falls below the one-cycle average COP=COP_CYCLE for a certain time in succession based on FIGS. 21 and 22. In FIG. 21, the horizontal axis represents time, and the vertical axis COP, respectively. Parts in FIG. 22 with no explanations in particular have the same contents as those explained in FIG. 18.

The heat pump apparatus 100*a* may start defrosting operation when the instantaneous COP=COP falls below the one-cycle average COP=COP_CYCLE for a certain time in succession as shown in FIG. 21. The flowchart then is shown in rig. 22. The defrosting operation is started when a timer TIMER is counted in step S604 and it is judged in step S605 that a certain time t has elapsed after the timer TIMER was set. (step S605; YES) If the conditions of step S603 are not fulfilled (step S603; NO) before the certain time t elapsed, reset the timer TIMER to redo the judgment. Thereby, the start of a false defrosting operation can be avoided when the instantaneous COP=COP falls below the one-cycle average COP=COP_CYCLE due to a sudden change in noises and the like.

Figure 23:
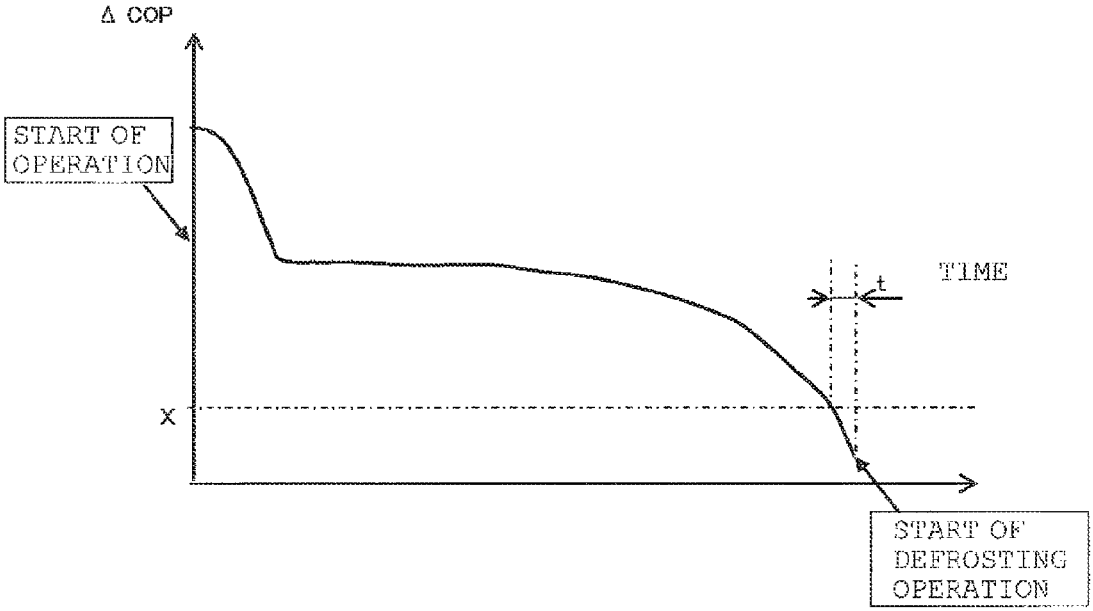
FIG. 23 is a graph showing a relation between time variation of COP and time of the heat pump apparatus.

FIG. 23 is a graph showing a relation between time variation of COP and time of the heat pump apparatus 100*a*. FIG.

24 is a flowchart showing still another example of the processing flow regarding defrosting start decision control of the heat pump apparatus 100*a*. Based on FIGS. 23 and 24, descriptions will be given to the processing flow when defrosting operation starts in the case where the instantaneous COP=COP falls below the one-cycle average COP=COP_CYCLE, and variations ΔCOP of the instantaneous COP=COP within a certain time falls below a preset value X for a certain time t in succession. In FIG. 23, the horizontal axis represents time, and the vertical axis ΔCOP, respectively. Parts in FIG. 24 with no particular explanations have the same contents as those explained in FIG. 18.

Figure 24:
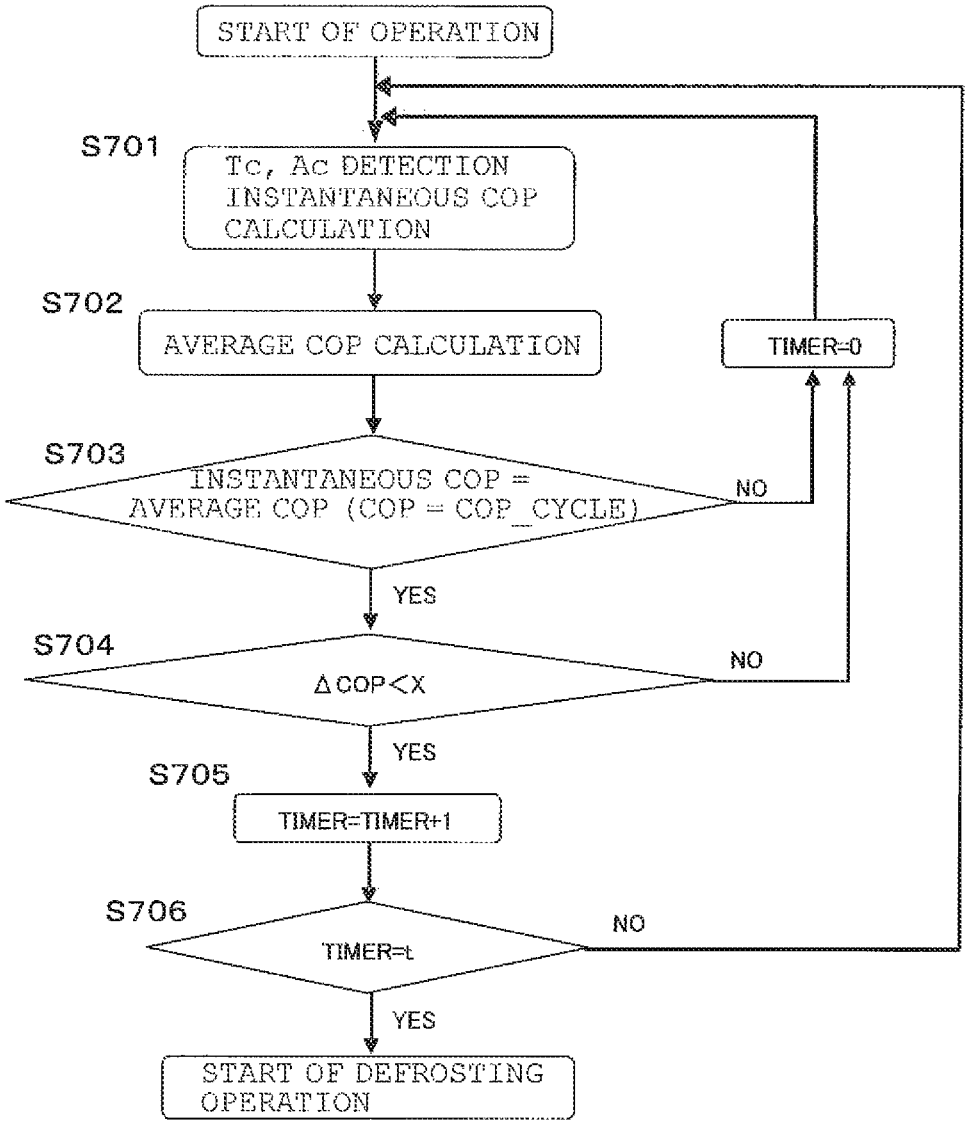
FIG. 24 is a flowchart showing further other example of the processing flow regarding defrosting start decision control of the heat pump apparatus.

The heat pump apparatus 100*a* may start defrosting operation when the instantaneous COP=COP falls below the one-cycle average COP=COP_CYCLE and, as shown in FIG. 23, variations ΔCOP of the instantaneous COP=COP within a certain time fall below a preset value X for a certain time t in succession. The flowchart then is shown in FIG. 24. If ΔCOP falls below X at step S704 (step S704; YES), count of the timer TIMER is started at step S705. If it is judged that a certain time t has elapsed after the timer TIMER was set at step S706, defrosting operation is started. (step S706; YES)

If conditions of step S703 or step S704 are not fulfilled before elapsing a certain time t (step S703; NO, or step S704; NO), reset the timer TIMER to redo the judgment. Thereby, a false defrosting operation start can be avoided caused by a sudden change in noises, a change of compressor frequency, and a temporarily change in COP due to load variations. The condensation temperature detection means 11 in Embodiment 2 may be means to directly measure temperature by the thermistor, means to convert the condensation temperature from the pressure sensor, or means to estimate the condensation temperature.

In Embodiments 1 and 2, no descriptions are given to kinds of the refrigerant circulating in the refrigeration cycle, however, kinds of the refrigerant are not limited in particular. For example, a natural refrigerant such as carbon dioxide, hydrocarbon, and helium, the refrigerant including no chloride such as an alternative refrigerant like HFC410A and HFC407C, or a fluorocarbon refrigerant such as R22 and R134*a* used for existing products may be allowable. The compressor 1 may be any of a variety of types, for example, reciprocating, rotary, scroll, or screw. The rotation speed may be either variable or fixed.

REFERENCE SIGNS LIST

1 compressor
2 condenser
3 expansion means
4 evaporator
5 condenser fan
6 evaporator fan
11 condensation temperature detection means
12 evaporation temperature detection means
13 compressor operation time measurement means
14 compressor operation current detection means
15 refrigerant piping
50 control section
51 memory
52 operation section
100, 100*a* heat pump apparatus

The invention claimed is:

1. A heat pump apparatus including a refrigerant circuit, in which a compressor, a condenser, expansion means, and an evaporator are serially connected, comprising:

a condensation temperature detection means that detects a saturation temperature of said condenser;

an evaporation temperature detection means that detects a saturation temperature of said evaporator; and a control section that estimates operation efficiency by a value obtained by dividing heating ability estimated from a detection value of said condensation temperature detection means by a difference between the detection value of said condensation temperature detection means and the detection value of said evaporation temperature detection means or dissipation power estimated from said difference, wherein the control section starts a defrosting operation when an estimated operation efficiency decreases to a value of average operation efficiency from a start of normal operation to an end of the defrosting operation when the defrosting operation is performed at the present time, where the value of average operation efficiency is estimated based on an average value of the operation efficiency from a start of normal operation to the present time.

2. The heat pump apparatus of claim 1, comprising compressor operation time measurement means that measures operation time of said compressor, wherein said control section estimates said operation efficiency when the detection time of said compressor operation time measurement means becomes a predetermined time or more.

3. The heat pump apparatus of claim 2, wherein said predetermined time is decided based on said defrosting operation time in the operation after said defrosting operation is started and completed.

4. The heat pump apparatus of claim 1, wherein said control section starts the defrosting operation when said estimated operation efficiency decreases down to a predetermined value and said operation efficiency falls below a predetermined value for a certain time in succession.

5. The heat pump apparatus of claim 1, wherein said control section starts the defrosting operation when said operation efficiency falls below a predetermined value and variations of said operation efficiency within a certain time falls below a preset value for a certain time in succession.

6. The heat pump apparatus of claim 1, wherein said control section starts the defrosting operation when said operation efficiency falls below a predetermined value and variations of said evaporation temperature within a certain time falls below a preset value for a certain time in succession.

7. A heat pump apparatus including a refrigerant circuit, in which a compressor, a condenser, expansion means, and an evaporator are serially connected, comprising:

a condensation temperature detection means that detects a saturation temperature of said condenser;

a compressor operation current detection means that detects an operation current of said compressor; and a control section that divides heating ability estimated by a detection value from said condensation temperature detection means by the detection value of said compressor operation current detection means or dissipation power estimated from said detection value from said compressor operation current detection means to estimate operation efficiency from a value obtained by dividing, and starts a defrosting operation when said estimated operation efficiency decreases from an average value of said operation efficiency from the start of operation up to the present time down to an estimation value of the operation efficiency from the start of operation to the end of the defrosting operation when performing the defrosting operation at the present time.

8. The heat pump apparatus of claim 7, wherein said control section starts the defrosting operation when said estimated operation efficiency decreases down to a predetermined value and said operation efficiency falls below a predetermined value for a certain time in succession.

9. The heat pump apparatus of claim 7, wherein said control section starts the defrosting operation when said operation efficiency falls below a predetermined value and variations of said operation efficiency within a certain time falls below a preset value for a certain time in succession.

10. The heat pump apparatus of claim 7, wherein said control section starts the defrosting operation when said operation efficiency falls below a predetermined value and variations of said evaporation temperature within a certain time falls below a preset value for a certain time in succession.

* * * * *